US005146697A

United States Patent [19]

Weiss

[11] Patent Number: 5,146,697

[45] Date of Patent: Sep. 15, 1992

[54] FLEXIBLE SHOE

[76] Inventor: Howard K. Weiss, 630 First Ave., New York, N.Y. 10016

[21] Appl. No.: 640,958

[22] Filed: Jan. 14, 1991

[51] Int. Cl.[5] ..... A43B 13/28; A43B 3/14; A43B 13/18; A43B 9/02

[52] U.S. Cl. ..... 36/12; 36/11; 36/17 R; 36/17 PW; 36/18; 36/21

[58] Field of Search ..... 36/12, 14, 17 R, 17 PW, 36/18, 11, 21

[56] References Cited

U.S. PATENT DOCUMENTS

| | | | |
|---|---|---|---|
| 656,472 | 8/1900 | Reed | 36/28 |
| 1,643,678 | 9/1927 | Peer | 36/17 R |
| 1,913,173 | 6/1933 | Silvestri | 36/17 R |
| 1,996,917 | 4/1935 | Gilkerson | 36/28 |
| 2,024,729 | 12/1935 | Gustin | 36/102 |
| 2,081,226 | 5/1937 | Cocozella | 36/28 |
| 2,106,676 | 1/1938 | Green | 36/28 |
| 2,112,142 | 3/1938 | Cohen | 36/12 |
| 2,126,601 | 8/1938 | Bain | 36/28 |
| 2,129,106 | 9/1938 | Szerenyi et al. | 36/28 |
| 2,178,629 | 11/1939 | Everston | 36/28 |
| 2,222,391 | 11/1940 | Andreasen | 36/28 |
| 2,276,686 | 3/1942 | Chevalier | 36/28 |
| 2,502,774 | 4/1950 | Alianiello | 36/28 |
| 2,565,662 | 8/1951 | McMahon | 36/28 |
| 2,817,163 | 12/1957 | Clark | 36/28 |
| 3,313,048 | 4/1967 | Beisner | 36/17 R |
| 4,463,505 | 8/1984 | Duclos | 36/25 R |
| 4,866,860 | 9/1987 | Blissett et al. | 36/28 |
| 4,942,679 | 7/1990 | Brandon et al. | 36/102 |
| 4,974,345 | 12/1990 | Yung-Mao | 36/28 |

FOREIGN PATENT DOCUMENTS

| | | | |
|---|---|---|---|
| 166619 | 2/1950 | Austria | 36/14 |
| 199092 | 11/1957 | Austria | 36/12 |
| 80460 | 9/1951 | Czechoslovakia | 36/14 |
| 661169 | 9/1928 | France | 36/14 |

*Primary Examiner*—Paul T. Sewell
*Assistant Examiner*—Marie D. Patterson
*Attorney, Agent, or Firm*—Robert S. Lipton

[57] ABSTRACT

A shoe having increased flexibility and ability to twist and bend in a variety of directions is disclosed. The shoe is constructed by an overlap slip last construction in which the last allowance of the upper of the shoe is stitched to the sole or mid-sole, not cemented to the sole. The presence of a full insole board and wrap in the forepart of the shoe as well as a conventional shank is eliminated.

25 Claims, 5 Drawing Sheets

FLEXIBLE SHOE

BACKGROUND OF THE INVENTION

The present invention relates to a shoe having a construction allowing the shoe to be flexed, twisted and bent in various directions and a method of manufacture thereof.

Traditionally, a shoe's flexibility has been limited to a partial bending of a shoe to conform to the shape of the foot while walking in largely one direction. The ability of the shoe to flex, twist or bend in other directions in response to stress vectors from different directions has been restricted.

In conventional slip lasted shoes necessary rigidity and structural support has been provided, at least in part, by stitching the uppers of a shoe to a sock or cloth-foam material and stitching the combined uppers and sock with an outer wrap material. The sock or cloth-foam material extend the length of the shoe. This wrap material also secures in place foam material as well as insole boards. The wrap material with the stitched sock and upper are then cemented to the sole. This conventional structure of a shoe inherently limits its flexibility.

Designs of shoes which allow for increased flexibility while not sacrificing sufficient rigidity and sturdiness are desired in a shoe. Designs which eliminate the need for the insole board, or a shank and which free the upper and sock portion of the shoe from the rigidity of the cemented sole are desirable for the added flexibility and comfort they would provide to the wearer of the shoe.

The following terms or phrases used throughout this application will be understood to have the following meanings:

"EVA" refers to the chemical compound ethylene vinyl acetate.

"Forepart" refers to that portion of the shoe or sole forward of the heel.

"Last" refers to a form or mold which simulates the shape of a foot and which is used to shape and size a shoe.

"Lasting Allowance" refers to that portion of a shoe upper which extends under the bottom of a last past the perimeter of the sole line. The lasting allowance then provides a surface area below the last for purposes of cementing or stitching said upper to the shoe.

"Shank" refers to a rigid longitudinal member extending from the mid-heel through the arch portion of the shoe in the forepart of the shoe.

"Slip Last Construction" refers to constructing a shoe by forming a fully enwrapped shoe upper which conforms to the shape of the last. The last is then forced into the enclosed upper for forming and attaching to the sole.

"Sock" refers to a cloth-like material which extends along the length of the shoe above the sole.

"Wrap" refers to a material which covers and seals the seam or location where the upper and sock are attached. The wrap also provides a surface known as the lasting allowance which is cemented to the sole.

SUMMARY OF THE INVENTION

In accordance with the present invention, there has been provided an overlap slip last construction which includes a last allowance stitched to the sole. The last allowance is formed by folding the upper inward toward a longitudinal mid-line of the shoe or under the bottom of the last. The last allowance is not cemented to the sole but rather is stitched to a sock material which is interposed between the last allowance and sole. The last allowance of the upper with the sock interposed is initially cemented and then additionally stitched to the sole.

In accordance with the invention, only the forepart of the shoe (not including the heel) is provided with the construction wherein the last allowance is stitched to the sole. It should be noted that in the forepart of the shoe, this last allowance forms an integral part of the upper of the shoe. Furthermore, the design according to the present invention eliminates the need for a wrap material in the forepart of the shoe. Rather, the shoe uses a storm welt in the forepart of the shoe for functional and aesthetic purposes. Functionally, the storm welt can help seal off water and the like from becoming interposed between the upper and the sole. Aesthetically, the storm welt provides visual continuity with the wrap material in the heel.

Stitching the upper (last allowance), sock and sole together in accordance with the invention eliminates the need for the wrap material and insole board heretofore used in conventional slip last shoe construction for rigidity and sturdiness. Furthermore, stitching the upper, sock and sole all together allows the entire forepart of the shoe to move together as a unit, thereby reducing the lack of rigidity inherent in conventional shoes in which the cemented sole binds and restricts the flexibility of the shoe. Thus, the sole does not restrict the flexibility of the shoe to the same extent that it does in conventionally constructed shoes. While the stitching of the sole to the upper allows for flexibility, the sole itself imparts sufficient rigidity and sturdiness as required in a shoe.

The sole also includes a cavity filled with a foam material such as EVA. This is done to impart additional flexibility. The foam material as well as portions of the sole are cemented to the sock to add to the integrity of the unit.

Unlike traditionally manufactured shoes, a standard shank has been omitted from the shoe. Rather, a built in shank design is provided in the sole. The built in shank design extends from the mid-heel to a metatarsal section of the sole acting as a bridge between the heel and sole. The built in shank design is integral with the sole and is part of the sole itself. The shank design simulates a shank and reinforces the heel by resisting the collapse of the heel as the foot bears down on the shoe. It should be noted that the built in shank design provides for support while not restricting the overall flexibility of the shoe to the extent conventional shanks would restrict flexibility.

Thus, in general, it is an object of the present invention to provide for a shoe having increased flexibility while not sacrificing required rigidity and sturdiness.

It is an object of the present invention to provide for this increased flexibility with a simple construction and elimination of elements heretofore used in conventional shoe construction.

It is a further object of the present invention to stitch the upper portion of the shoe to the sole and eliminate the need for a full insole board and/or separate wrap material.

It is a further object of the present invention to provide a shoe design in which the upper forms to the last without wrinkles forming in the upper.

The foregoing and other objects of the present invention will be more readily evident from the following detailed description of the preferred embodiment when considered in conjunction with the drawings.

BRIEF DESCRIPTION OF THE DRAWINGS

FIG. 1 shows a side plan view of the flexible shoe.

DETAILED DESCRIPTION OF THE PREFERRED EMBODIMENT

Figure 2:
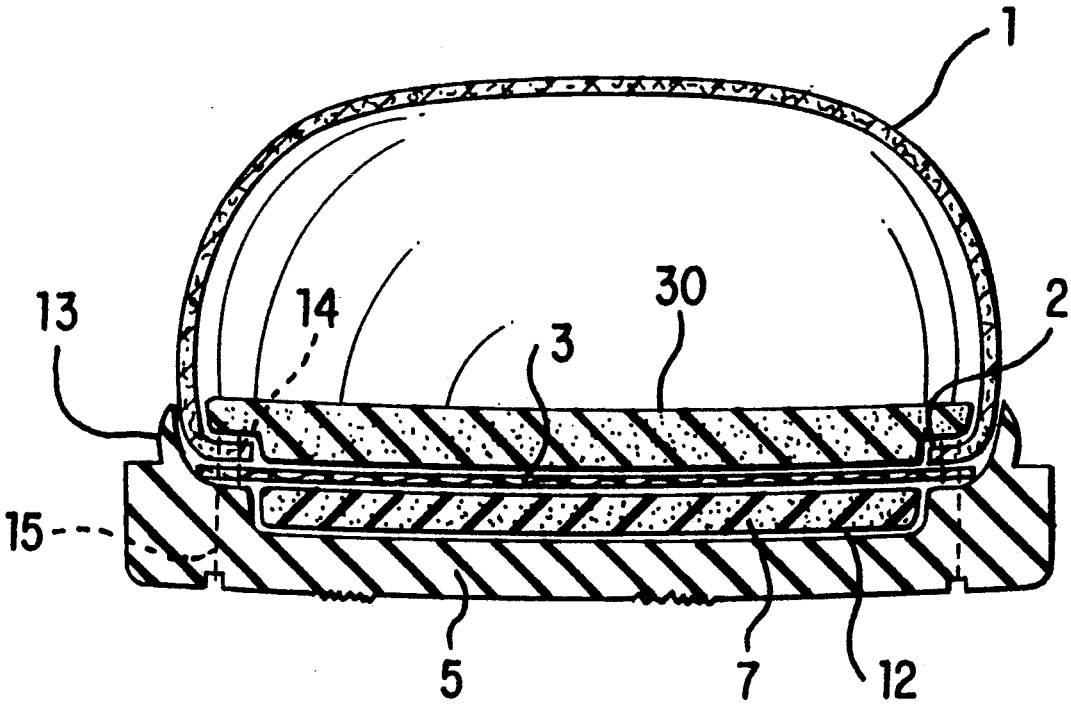
FIG. 2 shows a cross-sectional view of the forepart of the flexible shoe along lines 2—2 as drawn in FIG. 1.

A flexible shoe of the type shown in FIG. 1 is shown in cross-sectional detail in the forepart of the shoe in FIG. 2.

The shoe is formed by an overlapped slip last construction in the forepart of the shoe in which the uppers 1 are brought under a last to simulate a lasting allowance 2 in a conventional cement constructed shoe. The lasting allowance 2 is folded inward toward a longitudinal mid-line of the shoe. This overlap slip last construction allows the upper to form to the last without wrinkles. The lasting allowance by which the upper is attached to the sole extends about one fourth to about three eights of an inch inward toward a longitudinal mid-line of the shoe whereas standard lasting allowances typically extend to about one half of an inch. In general, the extent to which the lasting allowance will extend inward toward the longitudinal mid-line of the shoe will depend on the pattern of the shoe. The reduced size of the lasting allowance of the present invention helps reduce wrinkles.

It should be noted that the upper 1 can be made up of several different pieces of leather, animal hide, natural or synthetic material stitched together, or a unitary piece of leather, animal hide, natural or synthetic material.

The upper 1 is then stitched to a sock lining material 3 at the position of the lasting allowance 2. The upper 1 is inverted to allow for the stitching 14 after which it is turned again to an upright position to allow for insertion of a last.

In some embodiments the sock 3 can be extended along an inner wall of the upper to form a lining. Thus, in such a variation, it will be understood that the sock 3 can be adhered to or stitched along the upper in locations in addition to the location of the last allowance 2.

It should also be noted that the upper 1 itself can have an inner lining of cloth cemented to it or in a preferred embodiment pig skin is attached along an inner wall.

Figure 3:
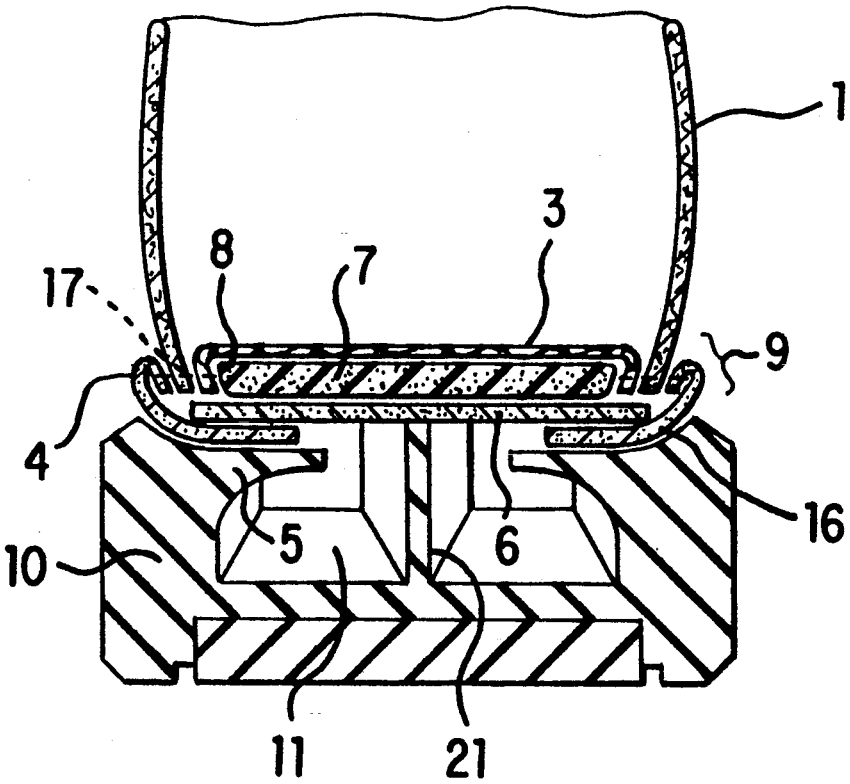
FIG. 3 shows a cross-sectional view of the heel of the flexible shoe along lines 3—3 as drawn in FIG. 1.

As shown in FIG. 3, the heel portion of the shoe is constructed according to known slip last construction in which a standard wrap 4 provides a last allowance 16 whose surface is cemented directly to the sole 5 and also surrounds an insole board 6 and foam material 7. Atop the foam material 7 is the sock material 3 which is attached at its edges 8 to the upper 1 by stitching 17. On the outer side of the upper 1, the wrap 4 bulges outward 9 sealing the upper-sock seam or attachment. The heel 10 may be composed of a honeycombed cell pattern 11 which imparts added cushioning. The heel 10 may have a triangular or cylindrical block to impart stability and comfort at compression points.

Figure 6:
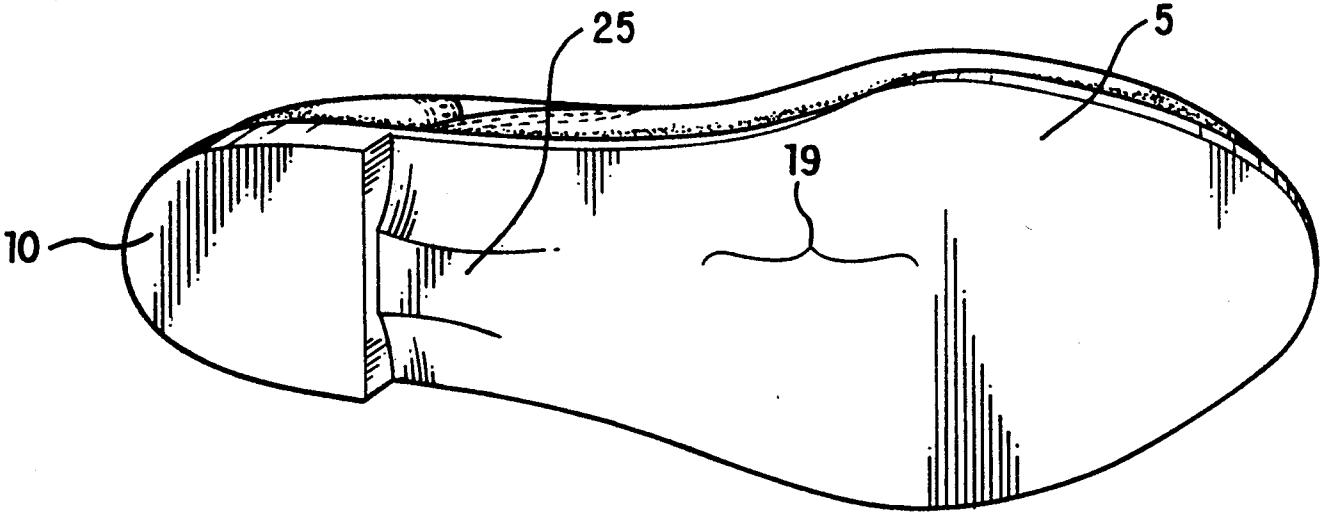
FIG. 6 shows a bottom side view of the sole of the shoe, particularly illustrating the built in shank design.

As shown in FIG. 2, the sole 5 in the forepart of the shoe is constructed with a cavity 12 which is filled with a flexible cushioning material 7. A material such as a soft EVA can be used or any other suitable material. This flexible material which fills the cavity 12 is cemented to the sole 5. This construction imparts added flexibility to the sole. As shown in FIG. 6, [T] the sole 5 contains a built in shank design 25 in a portion of the forepart of the sole adjacent to the heel 10. This shank design imparts stability. The built in shank 25 extends from a mid-portion of the forepart of the sole or metatarsal region 19 to the heel.

The sole and heel are further supported by additional cylindrical blocks added to the honeycomb design in the interior design of the heel.

Figure 4:
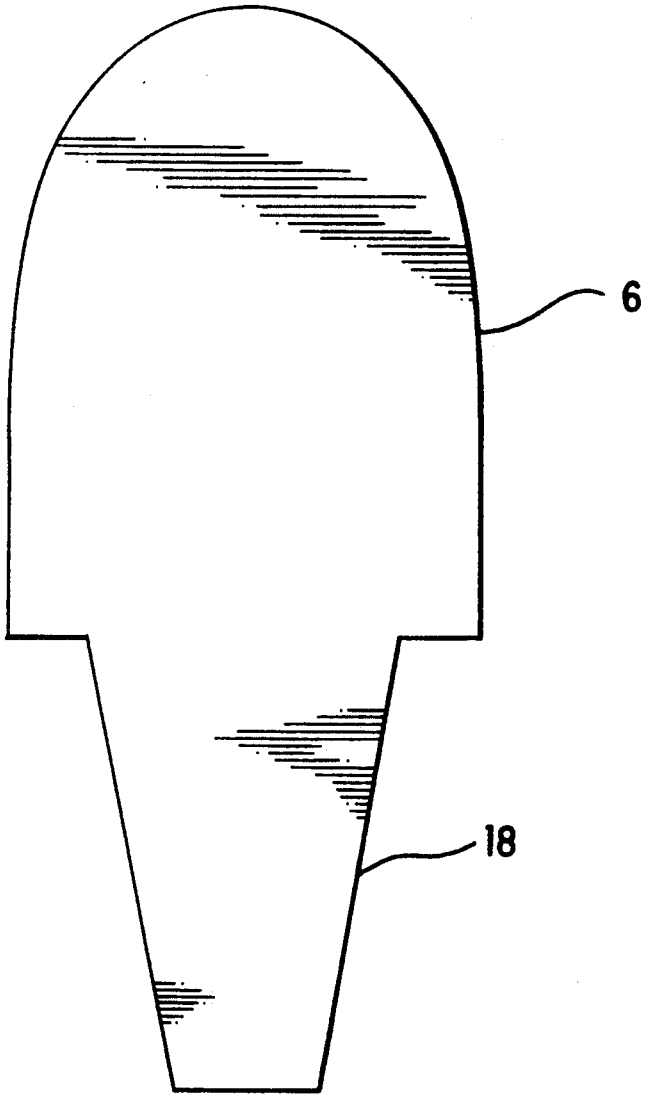
FIG. 4 shows a top plan view of the insole board used in the invention.

An insole board 6 as shown in FIG. 4 is held in place by the wrap material as shown in FIG. 3. The insole board 6 typically has foam glued onto it. The insole board 6 has a narrow tapered forward position 18 which cooperates with the built in shank design to provide some of the functionality of a conventional shank. The design of the insole board 6 of the present invention does not extend the length of the shoe, but rather extends along the heel and over the built in shank design in a tapered or narrowed fashion as shown in FIG. 4. The tapering 18 of the insole board 6 allows the shoe flexibility while still imparting some rigidity.

As shown in FIG. 2, in the forepart of the shoe, the last allowance 2 of the upper 1 and sock 3 are stitched to the sole 5. Thus, the sock 3 is interposed between the upper 1 and the sole 5. The last allowance 2 is then stitched to the sole in the forepart of the shoe. The stitch 15 traverses through the last allowance 2 of the upper and sole 5 binding them together. The stitching acts as a reinforcement for binding the upper to a sole. The stitch 15 can also traverse through the last allowance 2 of the upper 1, the sock 3 and sole 5 binding all three elements together. The stitching is accomplished by full Littleway sole stitch or other stitching to bind the stated elements together. In the heel portion of the shoe the last allowance 16 is not an integral part of the upper 1 and the last allowance 16 is cemented to the heel 10. In the heel portion of the shoe the upper 1 is not stitched to the sole 5 as is done in the forepart of the shoe.

While the heel 10 of the shoe has a conventional wrap 4 of FIGS. 1 and 3, the forepart of the shoe has a storm welt 13 along the periphery of the upper portion of the sole 5. The storm welt 13 forms a visually continuous shape with the wrap 4. That is, where the wrap 4 ends at the end of the heel portion, the storm welt 13 continues around the forepart of the shoe. The storm welt 13 not only enhances the visual appearance, but performs a functional purpose as well. This purpose is that of preventing water, rain, etc. from becoming interposed between the upper 1 and the sole 5. Other welt designs can be utilized in place of storm welts. These welt designs project from the sole and form a shallow well to insert the upper to the sole.

Figure 5:
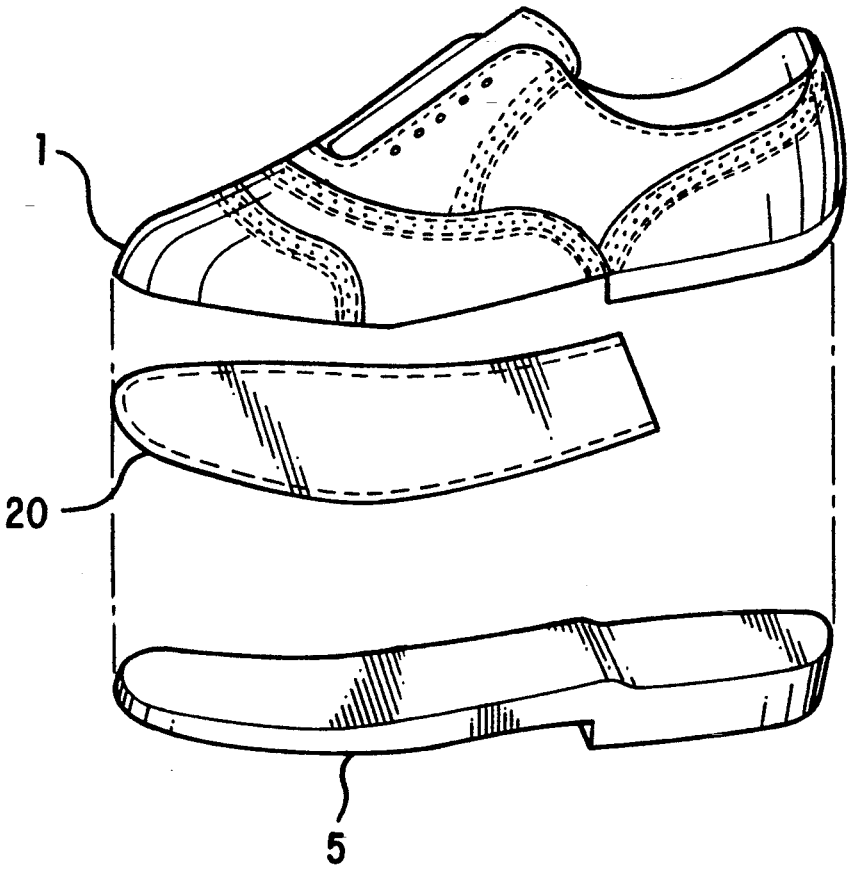
FIG. 5 shows an elevated side view of elements of an embodiment of the invention utilizing a mid-sole.
Figure 6:
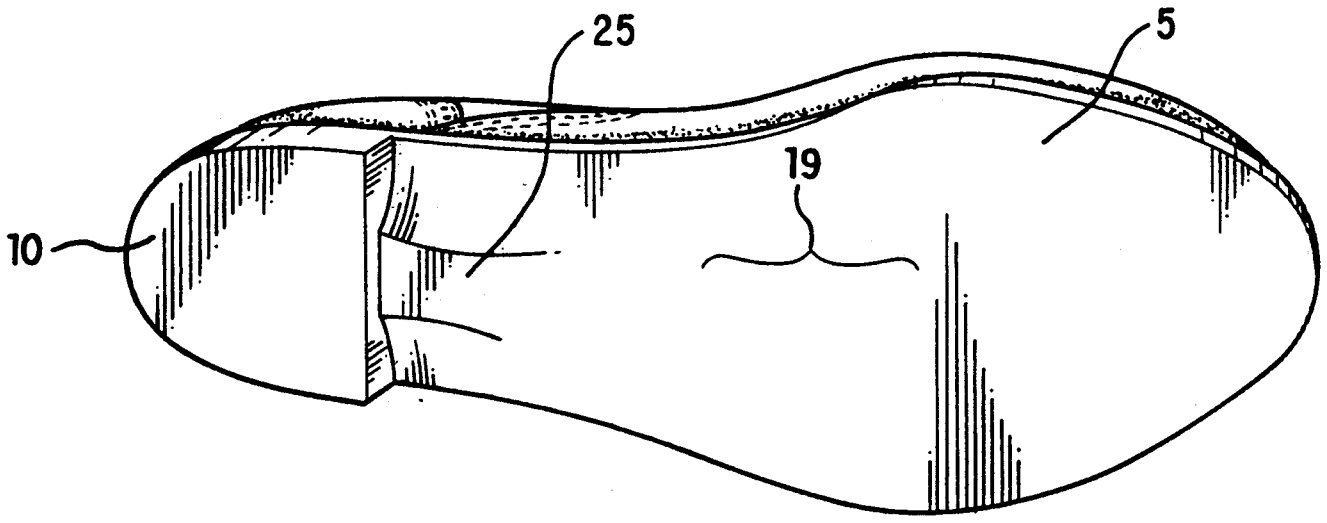

In an alternative embodiment of the present invention, the upper 1 can be stitched to a mid-sole 20 as shown in FIG. 5. In this embodiment, a mid-sole 20 is interposed between the upper 1 and the sole 5. The mid-sole 20 is made of a material which has a surface which is compatible for stitching to the upper 1 and a lower surface compatible for bonding or cementing to the sole 5. This variation using a mid-sole 20 for stitching to the upper 1 is desireable in situations where the sole 5 is too thick to allow for stitching the sole 5 to the upper 1 or where it would be difficult to stitch the upper 1 to a sole 5 because of the sole's material or thickness. This variation can also be employed when it is desired not to have stitches visible on the sole 5 for aesthetic reasons. The stitching between the upper 1 and mid-sole 20 would not be visible. This shoe, by virtue of the features disclosed in this patent application, will possess some flexibility.

It should also be noted that the present invention includes the use of various shoe inserts 30 which can be placed in the shoe to provide cushioning. The inserts 30 can be used to avoid contact of the foot with the last allowance where it is stitched to the sock in the forepart of the shoe. The use of the inserts can further provide comfort to the wearer of the shoe.

In a preferred mode of construction, the flexible shoe of the present invention may be formed as follows:

The upper 1 is first formed from one or several pieces as mentioned hereinabove.

Then in the heel portion of the shoe the upper 1 is stitched together with the sock 3 and wrap 4 from outside of the shoe.

The upper 1 is then turned inside out with the sock 3 and wrap 4 stitched to the rear or heel of the shoe.

The last allowance 2 of the upper 1 in the forepart of the shoe is then stitched to the sock 3 in such a manner that the last allowance 2 and sock 3 are in inverted positions to their positions in the heel 10; namely, the last allowance 2 is stitched on top of the sock 3.

The upper is inverted back into an upright position.

The upper 1 and sock 3 combination are forced onto the last.

An insole board 6 as shown in FIG. 4 is prepared so it has a narrow tapered forward portion 18 which acts in conjunction with the built in shank design to provide some of the functionality of a conventional shank. This tapering allows the shoe flexibility while still imparting some rigidity.

The wrap 4 is closed around an inserted insole board 6 in the heel portion of the shoe and secured to the insole board 6 by cementing. The forepart of the sole 5 is formed by impregnation or placing of a cushioning material such as, but not limited to, EVA in a cavity 12 of the sole 5. A shank equivalent 25 is incorporated in a portion of the forepart of the sole 5.

The sole 5 is cemented to the upper 1 by conventional methods starting at the toe. The soles 5 are conventionally heated prior to attachment and stretched as they are placed sequentially along the shoe. The sole 5 is then pressed to the upper 1 to facilitate the adherence of the sole 5 to the upper 1.

The shoe is removed from the last and the sole 5 is stitched to the upper 1 and sock 3 in the forepart of the shoe.

A final reconfiguring of the shoe may be required by placing the shoe on the last in order to restore the shape of the shoe which may have been distorted in the manufacturing process.

While preferred embodiments of the invention have been illustrated and described, it will be understood by those skilled in the art that changes and modifications may be restored to without departing from the spirit and scope of the invention.

What is claimed is:

1. A slip-lasted flexible shoe comprising:

a. a sock horizontally extended along the length of the shoe;

b. an upper with a last allowance in the forepart of the shoe;

c. a sole extending the length of the shoe and having a foam filled cavity in the forepart, said sole being stitched in the forepart to said upper at the position of said last allowance with said sock interposed and held by said stitching between said upper and said sole;

d. a shank design in the bottom of said sole, extending from the metatarsal region to a mid-portion of the heel for providing support without torsional rigidity;

e. an insole board substantially covering the heel area of said sole and further having a forward part which tapers in width, becoming narrower as the taper proceeds away from the width of said heel section, said insole board allowing for flexibility in the forepart of the shoe; and f. a wrap in the heel portion of the shoe which is fastened to said sock, said upper, and said insole board with said upper and insole board interposed between said wrap and said sock, said wrap having a lasting allowance affixed to said heel portion of said sole.

2. The shoe of claim 1 further comprising a shoe insert which covers the entire top surface of the inside bottom of the shoe.

3. The shoe of claim 1 wherein said last allowance of said upper is folded inward towards the interior of the shoe and stitched to said sock at the position of said last allowance.

4. The shoe of claim 1 wherein said allowance of said wrap is cemented to said heel.

5. The shoe of claim 1 further comprising a heel formed with honeycomb chambers.

6. The shoe of claim 5 wherein said insole board is interposed between said sock and said honeycomb chambers of said heel, said insole board being attached to said sock and said heel.

7. The shoe of claim 6 wherein cushioning foam is attached to said insole board.

8. The shoe of claim 7 wherein said cushioning foam in is EVA.

9. The shoe of claim 1 wherein said cushioning foam in said cavity of said sole is EVA.

10. The shoe of claim 1 further comprising an extended welt projecting from the top of said sole adjacent said upper along the length of said upper having said lasting allowance.

11. The shoe of claim 10 wherein said welt starts on one side of the shoe where said heel wrap ends and continues around the forepart of the shoe to the other side of the shoe to where said heel wrap begins.

12. The shoe of claim 1 wherein said upper is formed from a material selected from the group consisting of leather, animal hide, and other natural materials.

13. The shoe of claim 12 wherein said upper has an inner lining.

14. The shoe of claim 1 wherein said upper is formed from a synthetic material.

15. The shoe of claim 14 wherein said upper has an inner lining.

16. A method of manufacturing a flexible shoe, having a forepart and a heel comprising:

forming an upper on a last;

forming a sole with a built in shank design in a metatarsal region and filling a cavity of the sole with a foam material;

forming an insole board so that a narrow tapered forward portion results;

closing a wrap around the insole board in the heel portion of the shoe and securing the insole board to the wrap;

stitching the upper together with a sock and a wrap in the heel portion of the shoe;

stitching in the forepart of the shoe a last allowance of the upper to the sock so that the last allowance is superposed on top of the sock;

attaching the sole to the upper;

stitching the sole to the upper in the forepart of the shoe with the sock interposed between the upper and sole; and reconfiguring the shoe on the last.

17. The method of claim 16 wherein the sole is formed with a an extended welt in the forepart of the shoe.

18. The method of claim 16 wherein the insole board is formed with foam superposed and cemented to it.

19. The method of claim 16 wherein the wrap encloses an insole board and foam.

20. The method of claim 16 wherein after the upper is stitched to the heel portion of the shoe with a sock and a wrap, the upper is turned inside out.

21. The method of claim 16 wherein the upper is inverted and the last allowance of the upper in the forepart of the shoe is folded inward toward the interior of the shoe prior to stitching the last allowance of the upper to the sock and then reinverting the upper.

22. The method of claim 16 wherein the wrap is closed around the insole board and secured to the insole board by cementing.

23. The method of claim 16 wherein the foam is cemented to the insole board prior to securing the insole board to the wrap.

24. The method of claim 16 wherein said upper is formed from a material selected from the group consisting of leather, animal hide, and other natural materials.

25. The method of claim 16 wherein said upper is formed from a synthetic material.

* * * * *

UNITED STATES PATENT AND TRADEMARK OFFICE

CERTIFICATE OF CORRECTION

PATENT NO. : 5,146,697

DATED : September 15, 1992

INVENTOR(S) : Howard K. Weiss

It is certified that error appears in the above-identified patent and that said Letters Patent is hereby corrected as shown below:

In the drawing, sheet 1 of 5, FIG. 1, should be deleted and replaced by the following figure:

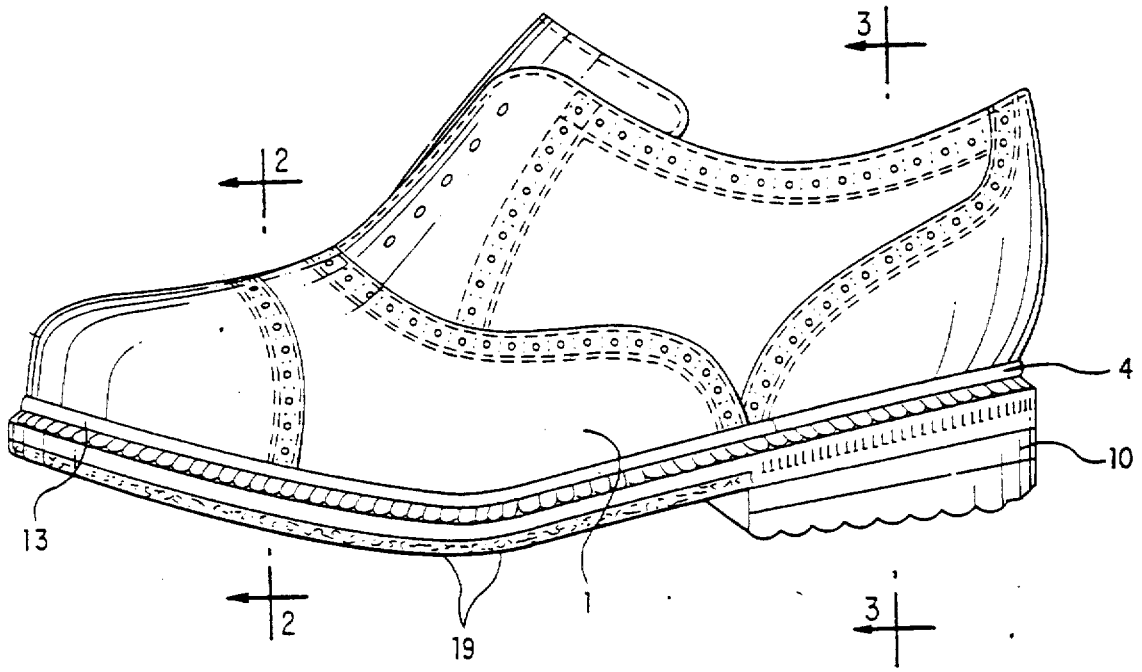

FIG. 1

UNITED STATES PATENT AND TRADEMARK OFFICE

CERTIFICATE OF CORRECTION

PATENT NO. : 5,146,697

DATED : September 15, 1992

INVENTOR(S) : Howard K. Weiss

It is certified that error appears in the above-identified patent and that said Letters Patent is hereby corrected as shown below:

Column 3, line 33, delete the word "eights" and insert in its stead the word --eighths--

Column 4, line 10, delete "[T]".

Signed and Sealed this

Fourteenth Day of September, 1993

Bruce Lehman

*Attest:*

BRUCE LEHMAN

*Attesting Officer*

*Commissioner of Patents and Trademarks*